US011208714B2

(12) United States Patent
Chang

(10) Patent No.: US 11,208,714 B2
(45) Date of Patent: Dec. 28, 2021

(54) APPARATUS AND METHOD FOR IN SITU STEAM GENERATION

(71) Applicant: Taiwan Semiconductor Manufacturing Co., Ltd., Hsinchu (TW)

(72) Inventor: Chun-Hao Chang, New Taipei (TW)

(73) Assignee: TAIWAN SEMICONDUCTOR MANUFACTURING CO., LTD, Hsinchu (TW)

( * ) Notice: Subject to any disclaimer, the term of this patent is extended or adjusted under 35 U.S.C. 154(b) by 74 days.

(21) Appl. No.: 16/181,489

(22) Filed: Nov. 6, 2018

(65) Prior Publication Data

US 2019/0085440 A1 Mar. 21, 2019

Related U.S. Application Data

(62) Division of application No. 14/158,369, filed on Jan. 17, 2014, now abandoned.

(51) Int. Cl.
*C23C 8/80* (2006.01)
*C23C 8/10* (2006.01)

(52) U.S. Cl.
CPC . *C23C 8/80* (2013.01); *C23C 8/10* (2013.01)

(58) Field of Classification Search
CPC ..... C23C 8/80; C23C 8/10
USPC ..... 427/248.1–255.7; 137/14, 81.1, 137/87.03–87.04, 102
See application file for complete search history.

(56) References Cited

U.S. PATENT DOCUMENTS

| | | | | |
|---|---|---|---|---|
| 4,550,245 | A | 10/1985 | Arai | |
| 5,288,684 | A | 2/1994 | Yamazaki | |
| 5,433,780 | A | 7/1995 | Ikeda | |
| 5,547,539 | A | 8/1996 | Arasawa | |
| 6,037,273 | A | 3/2000 | Gronet et al. | |
| 6,635,580 | B1 | 10/2003 | Yang | |
| 7,160,812 | B2 | 1/2007 | Hamada | |
| 7,972,441 | B2 | 7/2011 | Yokota | |
| 2002/0078976 | A1* | 6/2002 | Nguyen | H01L 21/67046 134/6 |
| 2003/0094909 | A1 | 5/2003 | Hishinuma | |
| 2004/0099213 | A1* | 5/2004 | Adomaitis | C23C 16/52 118/715 |
| 2004/0121598 | A1 | 6/2004 | Achutharaman et al. | |
| 2004/0155590 | A1 | 8/2004 | Belliveau | |
| 2005/0133157 | A1 | 6/2005 | Choi | |

(Continued)

*Primary Examiner* — Michael B Cleveland
*Assistant Examiner* — Michael G Miller
(74) *Attorney, Agent, or Firm* — McClure, Qualey & Rodack, LLP

(57) ABSTRACT

An apparatus for in situ steam generation oxidation are provided. The apparatus includes a reactor chamber. The apparatus also includes a radiant source over the chamber. The radiant source includes a plurality of lamps for heating the reactor chamber. The apparatus further includes a lamphead over the radiant source for adjusting the temperature of the radiant source. In addition, the apparatus includes a gas inlet system coupled to the lamphead. The gas inlet system includes a mass flow controller for adjusting the flow rate of cooling gas into the lamphead. The apparatus includes a gas outlet system, on the opposite side of the cooling gas inlet system, coupled to the lamphead. The gas outlet system includes a pressure controller for accelerating the exhaust rate of the cooling gas.

20 Claims, 4 Drawing Sheets

(56) References Cited

U.S. PATENT DOCUMENTS

| | | | | |
|---|---|---|---|---|
| 2005/0189074 | A1 | 9/2005 | Kasai | |
| 2005/0217993 | A1 | 10/2005 | Gebele | |
| 2006/0240680 | A1* | 10/2006 | Yokota | H01L 21/67115 438/800 |

* cited by examiner

APPARATUS AND METHOD FOR IN SITU STEAM GENERATION

CROSS REFERENCE TO RELATED APPLICATIONS

This application is a Divisional of U.S. patent application Ser. No. 14/158,369, filed on Jan. 17, 2014 and entitled "Apparatus and method for in situ steam generation."

BACKGROUND

In the fabrication of integrated circuits and other electronic devices, multi-layers of dielectric materials are deposited on or removed from a surface of a substrate. For example, features such as shallow trench isolation (STI) structures, liner layers, scarification layers, passivation layers, inter-layer dielectric (ILD) layers and gate dielectric layers are formed of the dielectric materials and play important roles during the fabrication and in the final structure of the integrated circuits.

The dielectric materials may be deposited by a number of deposition techniques. Examples of deposition techniques used in modern processing include in-situ steam generation (ISSG) oxidation, chemical vapor deposition (CVD), plasma-enhanced vapor deposition (PECVD), physical vapor deposition (PVD), atomic layer deposition (ALD), sputtering and spin coating.

BRIEF DESCRIPTION OF THE DRAWINGS

For a more complete understanding of the present disclosure, and the advantages thereof, reference is now made to the following descriptions taken in conjunction with the accompanying drawings.

DETAILED DESCRIPTION

The making and using of various embodiments of the disclosure are discussed in detail below. It should be appreciated, however, that the various embodiments can be embodied in a wide variety of specific contexts. The specific embodiments discussed are merely illustrative, and do not limit the scope of the disclosure.

It is to be understood that the following disclosure provides many different embodiments, or examples, for implementing different features of the disclosure. Specific examples of components and arrangements are described below to simplify the present disclosure. These are, of course, merely examples and are not intended to be limiting.

Moreover, the performance of a first process before a second process in the description that follows may include embodiments in which the second process is performed immediately after the first process, and may also include embodiments in which additional processes may be performed between the first and second processes. Various features may be arbitrarily drawn in different scales for the sake of simplicity and clarity. Furthermore, the formation of a first feature over or on a second feature in the description may include embodiments in which the first and second features are formed in direct or indirect contact.

Some variations of the embodiments are described. Throughout the various views and illustrative embodiments, like reference numbers are used to designate like elements. It is understood that additional operations can be provided before, during, and after the method, and some of the operations described can be replaced or eliminated for other embodiments of the method.

Embodiments of the present disclosure provide methods and apparatuses for in situ steam generation oxidation. In some embodiments, the apparatuses of the present disclosure include a control system that provides cooling gas of a stable flow rate for flowing through a lamphead. Accordingly, lamps used for heating a reactor chamber are stably cooled by the lamphead and generate substantially no temperature fluctuations to the reactor chamber. An oxide film having a uniform thickness is able to be deposited.

Figure 1:
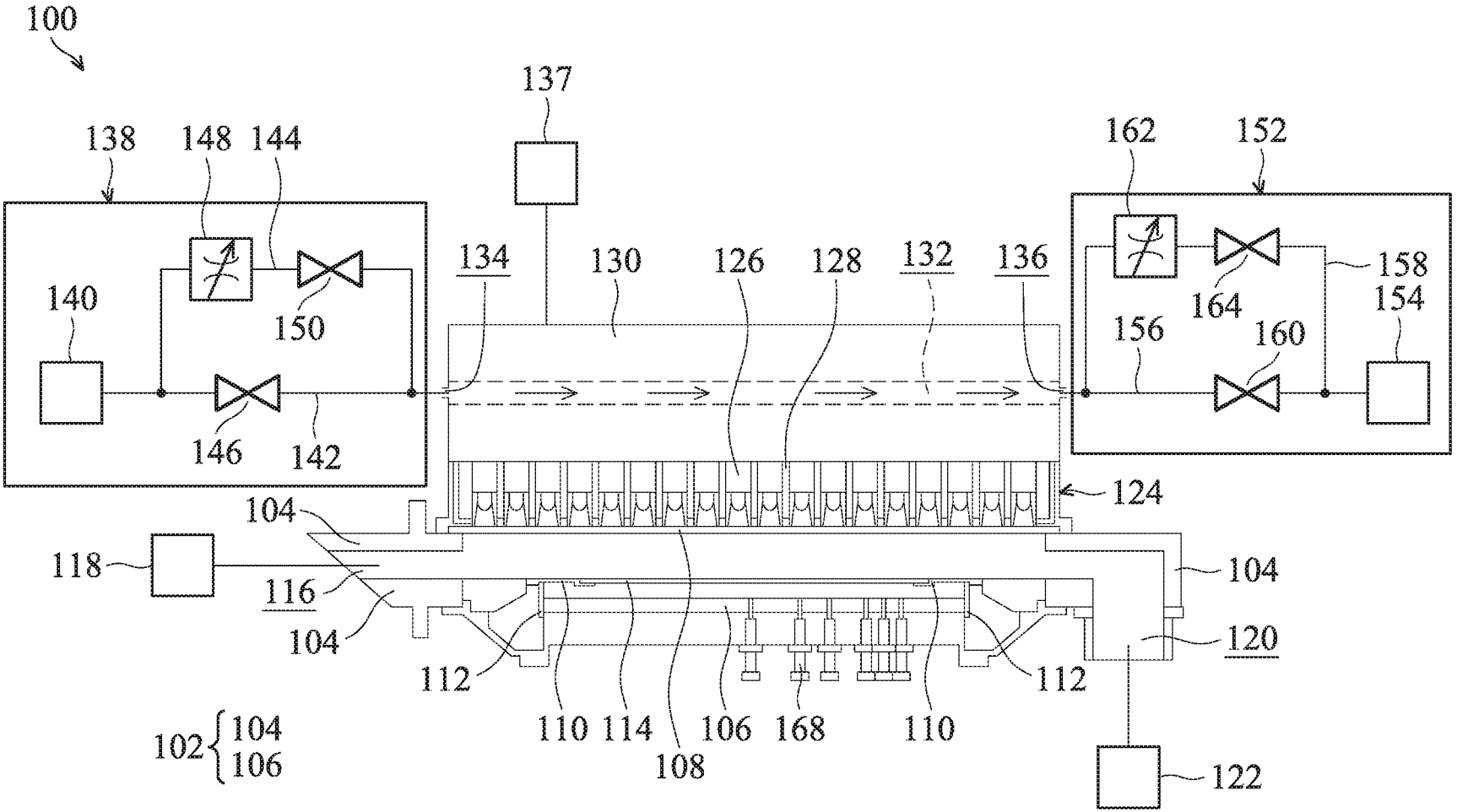
FIG. 1 shows a deposition apparatus which can be used to carry out in situ steam generation (ISSG) oxidation processing, in accordance with some embodiments of the present disclosure.

FIG. 1 shows a deposition apparatus 100 which can be used to carry out in situ steam generation (ISSG) oxidation processing, in accordance with some embodiments of the present disclosure. As shown in FIG. 1, an ISSG apparatus 100 includes a reactor chamber 102 enclosed by a sidewall 104 and a bottom wall 106. An upper portion of the sidewall 104 of the reactor chamber 102 is sealed to a window 108. A support ring 110 is mounted on a rotatable cylinder 112. The support ring 110 is used to support a substrate 114, such as a silicon wafer, on the edge of the substrate 114. In some embodiments, the substrate 114 includes regions where one or more semiconductor devices, or portions thereof, are formed (e.g., field effect transistors). The substrate 114 and the support ring 110 are capable of rotating by rotating the rotatable cylinder 112.

The ISSG apparatus 100 includes a process gas inlet 116 formed through the sidewall 104 for injecting process gas into the reactor chamber 102 to allow various processing steps to be carried out in the reactor chamber 102. A fluid source 118 is coupled to the process gas inlet 116. In some embodiments, the fluid source 118 includes a source of oxygen-containing gas and a source of hydrogen-containing gas. In some embodiments, the hydrogen-containing gas includes $H_2$, or other hydrogen-containing gases such as $NH_3$, deuterium or $CH_4$. In some embodiments, the oxygen-containing gas includes $O_2$, or other oxygen-containing gases such as $N_2O$. The ISSG apparatus 100 also includes a process gas outlet 120, on the opposite side of the process gas inlet 116, formed through the sidewall 104. The process gas outlet 120 is coupled to a vacuum source 122, such as an evacuation pump. The vacuum source 122 exhausts the process gas from the reactor chamber 102 while the process gas is continually fed into the reactor chamber 102 during processing.

A radiant source 124 is positioned over the window 108. The radiant source 124 includes a plurality of lamps 126, such as tungsten halogen lamps, each mounted into a light pipe 128. In some embodiments, the lamps 126 are positioned in a hexagonal array and adequately cover the entire surface area of substrate 114. The light pipes 128 and associated lamps 126 allow the use of the window 108 to provide an optical port for heating the substrate 114 within the reactor chamber 102. In some embodiments, the window 108 isolates the process environment from the lamps 126 since the lamps 126 can get too hot and react with the process gas.

A lamphead 130 is positioned over the radiant source 124 for cooling the lamps 126. In some embodiments, the lamphead 130 helps the lamps 126 provide constant thermal energy to the reactor chamber 102 while extends the lifespan of the lamps 126. In some embodiments, the lamphead 130 adequately covers the entire upper surface area of the radiant source 124 and connects to the light pipes 128. The lamphead 130 includes one or more channels 132 for allowing cooling gas to flow through the lamphead 130. In some embodiments, the cooling gas includes Ar, He, Ne, $N_2$ or other suitable gases which have not reacted with the process gas during processing. The lamphead 130 includes a cooling gas inlet 134 that is coupled to the channel 132 for injecting the cooling gas into the lamphead 130. The lamphead 130 also includes a cooling gas outlet 136 on the opposite side of the cooling gas inlet 132. The cooling gas outlet 136 is coupled to the channel 132 for exhausting the cooling gas from the lamphead 130. In some embodiments, a pressure sensor 137 is coupled to the lamphead 130 for sensing the pressure in the lamphead 130.

A gas inlet system 138 is coupled to the cooling gas inlet 132 of the lamphead 130. In some embodiments, the gas inlet system 138 includes a source of the cooling gas 140, a first pipeline 142 and a second pipeline 144. The first pipeline 142 is the means by which the source of the cooling gas 140 commutes with the cooling gas inlet 132 to feed the cooling gas into the lamphead 130. The second pipeline 144 is a bypass pipeline of the first pipeline 142. In some embodiments, the first pipeline 142 and the second pipeline 144 respectively contain valves 146 and 150. In a view of the flowing direction of the cooling gas, the second pipeline 144 is diverted from the first pipeline 142 at a first location before reaching the valve 146 of the first pipeline 142 and rejoins the first pipeline 142 at a second location after crossing the valve 146. The valve 146 of the first pipeline 142 is between the first location and the second location. In other words, the valves 146 and 150 of the first pipeline 142 and the second pipeline 144 are connected in parallel for deciding the flow path of the cooling gas. The second pipeline 144 further contains a mass flow controller 148 which connects to the valve 150 in series. The mass flow controller 148 may adjust the flow rate of the cooling gas. In some embodiments, the mass flow controller 148 provides the cooling gas at an adjusted flow rate to the first pipeline 142 and the lamphead 130 while the valve 146 of the first pipeline 142 is closed. In some embodiments, the mass flow controller 148 is electrically connected to the pressure sensor 137 and is able to receive a signal from the pressure sensor 137.

A gas outlet system 152 is coupled to the cooling gas outlet 136 of the lamphead 130. In some embodiments, the gas outlet system 152 includes an evacuation pump 154, a third pipeline 156 and a fourth pipeline 158. The third pipeline 156 is in communication between the evacuation pump 154 and the cooling gas outlet 136 for exhausting the cooling gas from the lamphead 130. The evacuation pump 154 and the source of the cooling gas 140 generate the flow of the cooling gas. The fourth pipeline 158 is a bypass pipeline of the third pipeline 156. In some embodiments, the third pipeline 156 and the fourth pipeline 158 respectively contain valves 160 and 164. In a view of exhausting direction of the cooling gas, the fourth pipeline 158 is diverted form the third pipeline 156 at a third location before reaching the valve 160 of the third pipeline 156 and rejoins the third pipeline 156 at a fourth location after crossing the valve 160. The valve 160 of the third pipeline 156 is between the third location and the fourth location. In other words, the valves 160 and 164 of the third pipeline 156 and the fourth pipeline 158 are connected in parallel for deciding the exhausting path of the cooling gas. The fourth pipeline 158 further contains a pressure controller 162 which connects to the valve 164 in series. In some embodiments, the pressure controller 162 includes an evacuation pump, which works while the pressure in the lamphead 130 is sensed to have changed. In some embodiments, the pressure controller 162 accelerates the exhaust rate of the cooling gas for reducing the pressure in the lamphead 130. In some embodiments, the pressure controller 162 is electrically connected to the pressure sensor 137 and is able to receive a signal from the pressure sensor 137.

The bottom wall 106 of the ISSG apparatus 100 includes a top surface for reflecting energy onto the backside of substrate 114. Additionally, the ISSG apparatus 100 includes a plurality of fiber optical temperature probes 168 positioned through the bottom wall 106. These fiber optic temperature probes detect the temperature of the substrate 114 at a plurality of locations across its bottom surface. Reflections between the backside of the substrate 114 and the reflecting surface create a blackbody cavity, which provides accurate temperature measurement capability.

Figure 2:
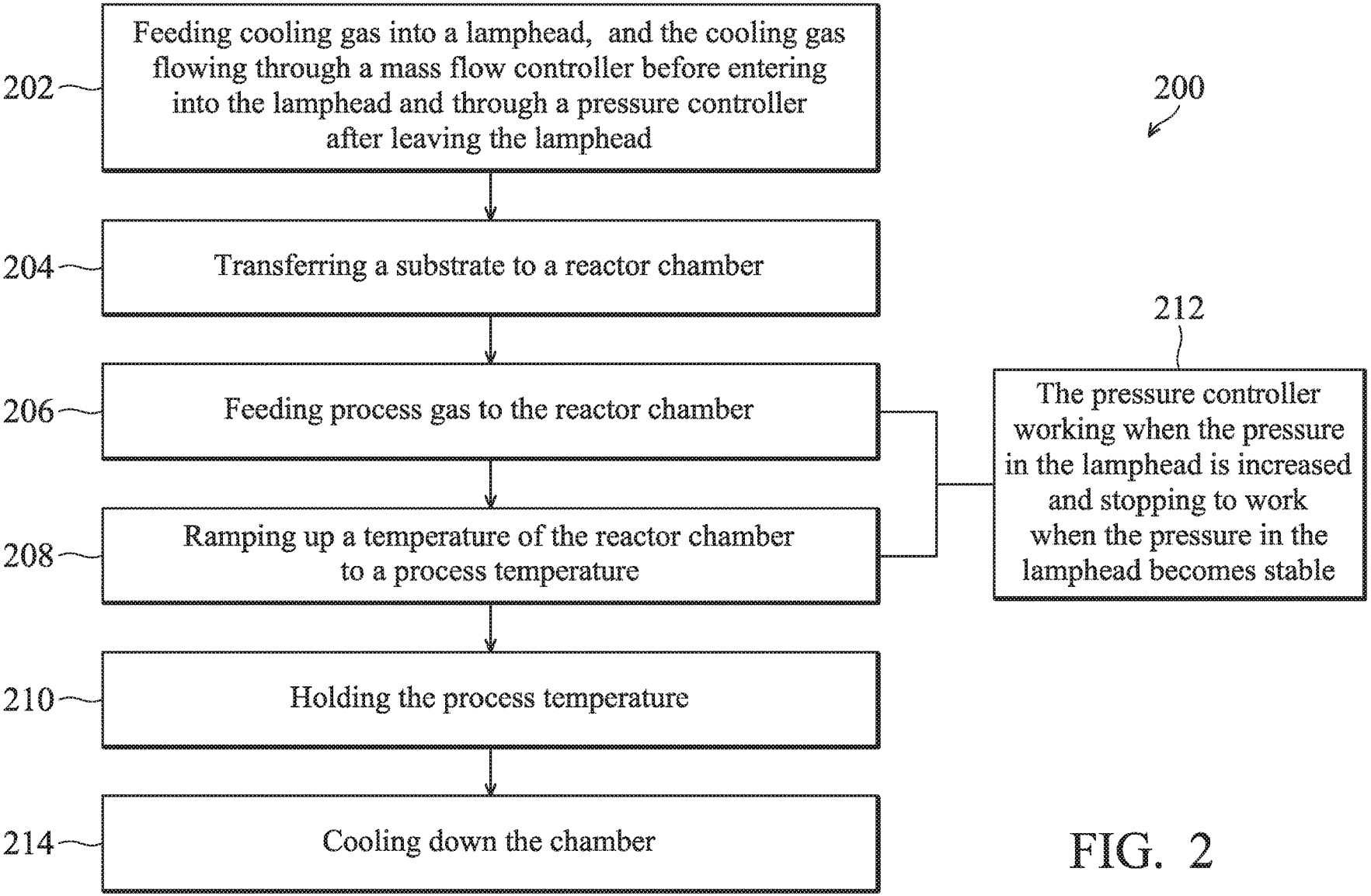
FIG. 2 shows a method for forming an oxide layer by ISSG oxidization processing, in accordance with some embodiments of the present disclosure.

Referring to FIG. 2, a method 200 for forming an oxide layer by the ISSG oxidization processing is illustrated in a flow chart form, in accordance with some embodiments of the present disclosure. In the following descriptions, the method 200 will be described to accompany the ISSG apparatus 100 illustrated in FIG. 1.

Referring back to FIG. 2, the method 200 includes operation 202, in which cooling gas is fed into a lamphead. The cooling gas flows through a mass flow controller before entering into the lamphead and flows through a pressure controller after leaving the lamphead. As illustrated in FIG. 1, the cooling gas is fed into the lamphead 130 from the gas inlet system 138 and exhausts to the gas outlet system 152. The source of the cooling gas 140 continually feeds the cooling gas to lamphead 130 at a constant rate, and the evacuation pump 154 continually extracts the cooling gas from the lamphead 130 at a constant rate. Accordingly, the source of the cooling gas 140 and the evacuation pump 154 generate the flow of the cooling gas at a constant rate. In some embodiments, the flow rate of the cooling gas is further adjusted by the mass flow controller 148. For example, the flow rate of the cooling gas is maintained at a constant rate that ranges from about 5 sccm to about 40 sccm. In some embodiments, while the cooling gas is continually feeding the lamphead 130, the valve 146 of the first pipeline 142 is closed, and the valve 150 of the second pipeline 144 is open. As such, the cooling gas flows through the mass flow controller 148 on the second pipeline 144 before entering into the lamphead 130. In some embodiments, while the cooling gas is continually being extracted from the lamphead 130, the valve 160 of the third pipeline 156 is closed, and the valve 164 of the fourth pipeline 158 is open. Accordingly, the exhausting cooling gas from the lamphead 130 flows through the pressure controller 162 on the fourth pipeline 158 to the evacuation pump 154. In some embodiments, the cooling gas keeps flowing and is adjusted by the mass flow controller 148 throughout the operations of the method 200.

The method 200 continues to operation 204, in which a substrate is transferred to a reactor chamber. As illustrated in FIG. 1, the substrate 114 is transferred to the reactor chamber 102 by a robot arm (not shown). The reactor chamber 102 is then sealed and pumped down.

The method 200 continues to operation 206, in which the process gas is fed to the reactor chamber. As illustrated in FIG. 1, the process gas, including the hydrogen containing gas and the oxygen containing gas, is fed to the reactor chamber 102 from the fluid source 118. In some embodiments, the process gas includes a mixture of $H_2$ and $O_2$ that has a $H_2/O_2$ ratio ranging from about 10:1 to about 0.001:1. The hydrogen containing gas (e.g., $H_2$) and the oxygen containing gas (e.g., $O_2$) can be reacted together to from water vapor ($H_2O$) and a large amount of oxygen radicals having a rich reactivity.

The method 200 continues to operation 208, in which the temperature of the reactor chamber is ramped up to the process temperature. As illustrated in FIG. 1, power is applied to the lamps 126 for ramping up the temperature of the lamps 126 as well as ramping up the temperature of the reactor chamber 102 to the process temperature. In some embodiments, the process temperature is in a range from about 600 degrees Celsius to about 1200 degrees Celsius. As the temperature of the reactor chamber 102 is ramped up, the hydrogen containing gas and the oxygen containing gas begin to react to form $H_2O$ steam and a large amount of oxygen radicals. The oxygen radicals may oxidize a surface of the substrate 114 to form an oxide film on the substrate 114. In some embodiments, the temperature of the reactor chamber 102 is ramped up to the process temperature at a rate ranging from 10 degrees Celsius/sec to about 100 degrees Celsius/sec.

Afterwards, the method 200 continues to operation 210, in which the process temperature is held constant for a sufficient period of time. The ISSG oxidation processing is carried out until a desired thickness of the oxide film is achieved. In some embodiments, the process temperature and time are varied with the desired thickness of the oxide film.

The method 200 also includes operation 210, in which the pressure controller works when the pressure in the lamphead is increased and stops working when the pressure in the lamphead becomes stable. In some embodiments, the operation 210 is performed at any stage of the method 200, especially suitable for operations 206 and 208.

As illustrated in FIG. 1, when the temperature of the lamps 126 ramps up, the temperature and pressure of the cooling gas in the lamphead 130 are also influenced. For example, the temperature and pressure of the cooling gas in the lamphead 130 are increased as the temperature of the lamps 126 is ramped up, resulting in an unstable cooling effect on the lamps 126. The unstable cooling effect may cause the temperature of the lamps 126 and the reactor chamber 102 to fluctuate, and the accompanying thickness fluctuations in the deposited oxide film. In addition, when the temperature of the reactor chamber 102 is held at the process temperature, sometimes temperature fluctuations still occur in the lamps 126 and the reactor chamber 102 due to various factors.

In some embodiments, to reduce or eliminate the temperature fluctuations, the pressure controller 162 works when the pressure in the lamphead 130 is sensed to have changed. For example, the pressure controller 162 works each time about 1 torr of the pressure in the lamphead 130 is sensed to have changed. The pressure controller 162 may accelerate the exhaust rate of the cooling gas from the lamphead 130 until the pressure in the lamphead 130 becomes stable. For example, a range from about 5 sccm to about 50 sccm of the exhaust rate of the cooling gas is accelerated by the pressure controller while it works. In some embodiments, the pressure controller 162 begins to work when receiving a signal from the pressure sensor 137.

In some embodiments, the mass flow controller 148 further reduces the flowing rate of the cooling gas flowing into the lamphead 130 each time the pressure in the lamphead 130 is not reduced quickly enough by the pressure controller 162. The mass flow controller 148 returns to provide the original feeding rate of the cooling gas when the pressure in the lamphead 130 becomes stable. For example, a range from about 5 sccm to about 50 sccm of the flow rate of the cooling gas is reduced by the mass flow controller 148 while it works to further reduce the flow rate. In some embodiments, the pressure controller 162 begins to work when receiving a signal from the pressure sensor 137.

In some embodiments, the source of the cooling gas 140 and the evacuation pump 154 are continually feeding and extracting the cooling gas at a constant rate whether the pressure of the pressure controller 162 and/or the mass flow controller 148 is working or not. In some embodiments, by the work of the pressure controller 162 and/or the mass flow controller 148, the pressure and temperature of the cooling gas in the lamphead 130 are substantially held constant. In some embodiments, the oxide film having a substantially uniform thickness is deposited on the substrate 114.

Afterwards, the method 200 continues to operation 212, in which the chamber is cooled down. As illustrated in by FIG. 1, the power to lamps 126 is reduced or turned off to reduce the temperature of the reactor chamber 102 below the process temperature to cease the ISSG oxidization. In some embodiments, the pressure in the reactor chamber 102 is pumped down to below 1 torr, to ensure that no residual oxygen containing gas and hydrogen containing gas are present in reactor chamber 102. In some embodiments, the reactor chamber 102 is then backfilled with an inert gas to the desired transfer pressure of about 20 torr. Afterwards, the substrate 114 is transferred out of the reactor chamber 102 to complete the ISSG oxidization processing. In some embodiments, a new substrate may be transferred into the reactor chamber 102 and the operations set forth in flow chart 300 are repeated.

Figure 3A:
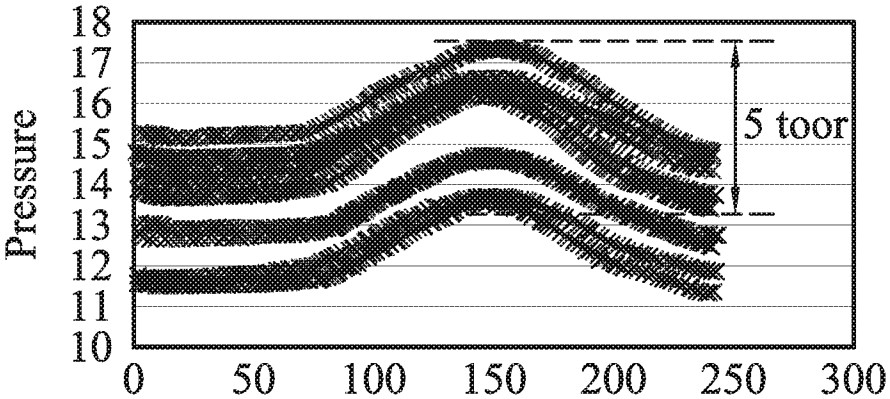
FIGS. 3A and 3B, respectively, show schemes of pressure variations during ISSG oxidation processing, performed in ISSG apparatuses before and after mounting a mass flow controller and a pressure controller, in accordance with some embodiments of the present disclosure.
Figure 3B:
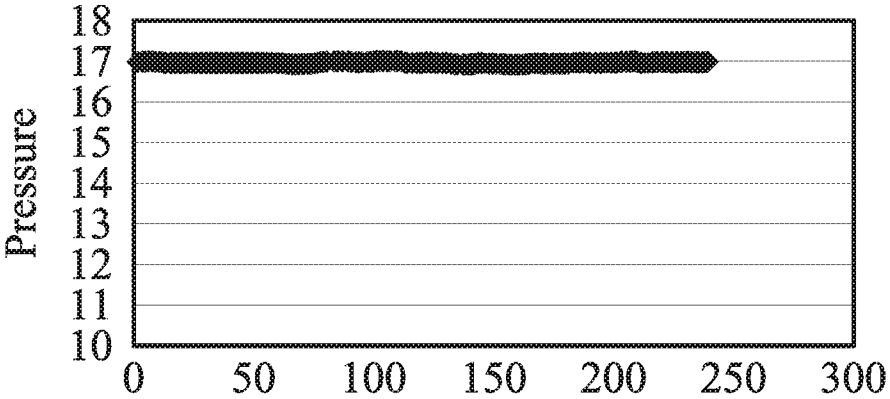
Figure 4:
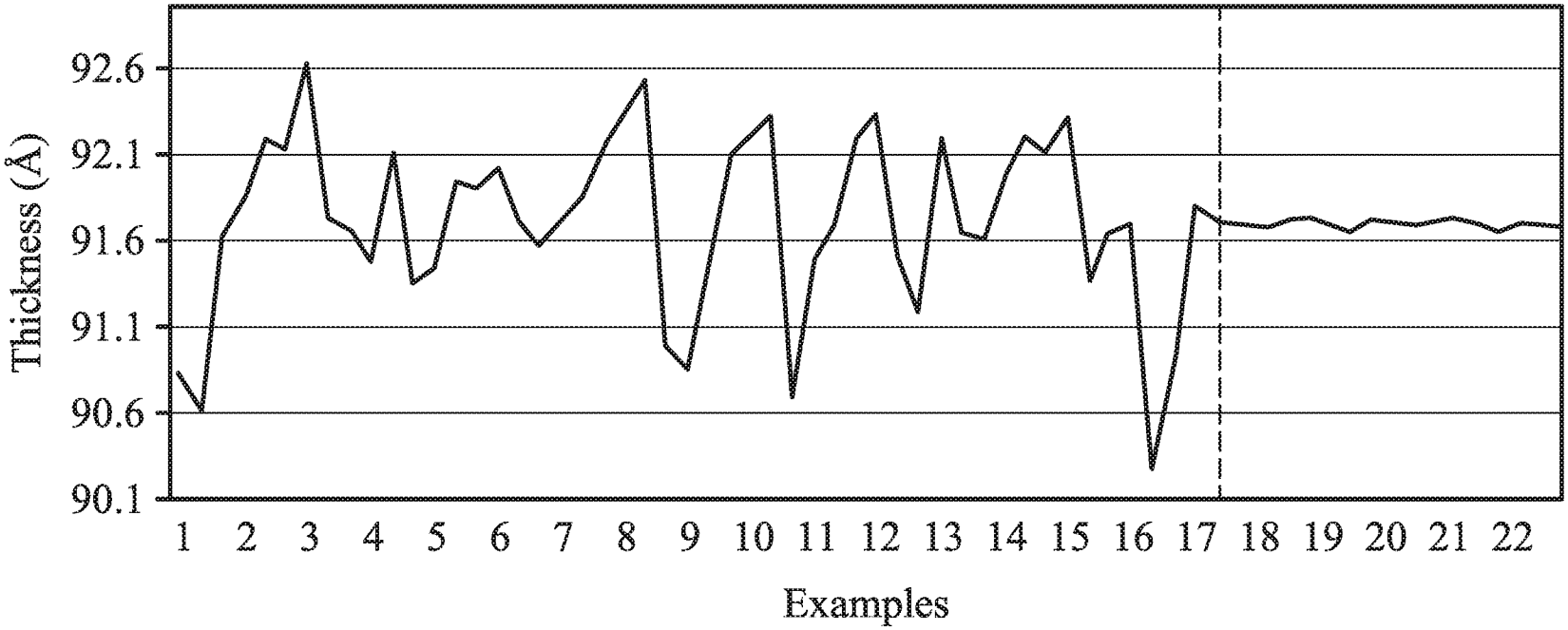
FIG. 4 shows a scheme of thicknesses of oxide films deposited by ISSG oxidation processing, performed in ISSG apparatuses before and after mounting a mass flow controller and a pressure controller, in accordance with some embodiments of the present disclosure.

FIGS. 3A and 3B, respectively, shows schemes the pressure variations during ISSG oxidation processing, performed in ISSG apparatuses before and after mounting the mass flow controller and the pressure controller, in accordance with some embodiments. A comparison of the FIGS. 3A and 3B clearly shows that the pressure fluctuation in the lamphead is reduced from about 5 torr (FIG. 3A) to substantially zero (FIG. 3B) by the use of the mass flow controller and the pressure controller. In addition, referring to FIG. 4, it shows a scheme of thickness oxide films formed by ISSG oxidation processing, performed in ISSG apparatuses before (left area from the dotted line) and after (right area from the dotted line) mounting the mass flow controller and the pressure controller, in accordance with some embodiments. In the comparison of the left area and the right area in FIG. 4, it clearly shows that the oxide films (Examples 18 to 22) can have a uniform thickness by the use of the mass flow controller and the pressure controller.

According to some embodiments, an ISSG apparatus is provided. The ISSG apparatus includes a gas inlet system and a gas outlet system coupled to a lamphead. In some embodiments, the gas inlet system and the gas outlet system can provide a cooling gas at a constant flow rate flowing through the lamphead and cause the lamps to provide stable thermal energy to the reactor chamber. Accordingly, the oxide film deposited within the reactor chamber can have a uniform thickness.

According to some embodiments, an apparatus for in situ steam generation oxidation is provided. The apparatus includes a reactor chamber. The apparatus also includes a radiant source over the chamber. The radiant source includes a plurality of lamps for heating the reactor chamber. The apparatus further includes a lamphead over the radiant source for adjusting the temperature of the radiant source. In addition, the apparatus includes a gas inlet system coupled to the lamphead. The gas inlet system includes a mass flow controller for adjusting the flow rate of cooling gas into the lamphead. The apparatus includes a gas outlet system, on the opposite side of the cooling gas inlet system, coupled to the lamphead. The gas outlet system includes a pressure controller for accelerating the exhaust rate of the cooling gas.

A method of in situ steam generation oxidation is provided. The method includes providing a deposition apparatus. The deposition apparatus includes a reactor chamber, a radiant source positioned over the reactor chamber for heating the reactor chamber and a lamphead positioned over the radiant source for cooling the radiant source. The method also includes providing a cooling gas flowing through the lamphead. The cooling gas flows through a mass flow controller before entering into the lamphead and flows through a pressure controller after leaving the lamphead. The method further includes transferring a substrate to the reactor chamber. In addition, the method includes feeding process gas into the reactor chamber. The method includes ramping up the temperature of the reactor chamber to a process temperature to perform the in situ steam generation oxidation to oxidize the substrate. The method also includes cooling down the temperature of the reactor chamber after an oxide film is formed on the substrate. The pressure controller works to reduce the pressure in the lamphead when the pressure in the lamphead is increased and stops working when the pressure in the lamphead becomes stable.

According to some embodiments, an apparatus for in situ steam generation oxidation is provided. The apparatus includes a radiant source over the chamber. The radiant source includes a plurality of lamps for heating the reactor chamber. The apparatus also includes a lamphead over the radiant source for adjusting the temperature of the radiant source. The apparatus further includes a gas inlet system coupled to the lamphead. The gas inlet system includes a first pipeline for feeding cooling gas into the lamphead and a second pipeline for providing the cooling gas at an adjusted flow rate to the first pipeline. In addition, the apparatus includes a gas outlet system, on the opposite side of the gas inlet system, coupled to the lamphead. The gas inlet system comprises a third pipeline for exhausting the cooling gas from the lamphead, and a fourth pipeline for providing the cooling gas at an adjusted exhaust rate to the third pipeline.

Although embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A method of in situ steam generation oxidation, comprising:

providing a deposition apparatus, which comprises a reactor chamber, a radiant source positioned over the reactor chamber for heating the reactor chamber and a lamphead positioned over the radiant source for cooling the radiant source;

providing a cooling gas flowing through a channel of the lamphead, wherein the cooling gas flows through a mass flow controller before entering into the channel and flows through a pressure controller after leaving the channel, wherein the mass flow controller is provided on a second pipeline that is a bypass pipeline of a first pipeline, wherein the pressure controller is provided on a fourth pipeline that is a bypass pipeline of a third pipeline, wherein the cooling gas does not flow through the first pipeline when the cooling gas is flowing through the mass flow controller, wherein the cooling gas does not flow through the third pipeline when the cooling gas is flowing through the pressure controller;

providing a pressure sensor directly sensing the pressure in the channel;

transferring a substrate to the reactor chamber;

feeding a process gas into the reactor chamber;

ramping up the temperature of the reactor chamber to a process temperature to perform the in situ steam generation oxidation to oxidize the substrate; and cooling down the temperature of the reactor chamber after an oxide film is formed on the substrate, wherein the pressure sensor outputs a signal based on the sensed pressure in the channel, wherein the pressure controller is electrically connected to the pressure sensor and is able to receive the signal from the pressure sensor;

wherein the pressure controller works to reduce the pressure in the channel when the signal indicates that the pressure in the channel is increased, and stops working when the signal indicates that the pressure in the channel becomes stable, wherein the mass flow controller is electrically connected to the pressure sensor and is configured to receive the signal from the pressure sensor, wherein the mass flow controller is configured to control the flow rate of the cooling gas feeding into the channel based on the signal, wherein the mass flow controller reduces the flow rate of the cooling gas feeding into the channel each time the pressure in the channel is not reduced quickly enough by the pressure controller, wherein the mass flow controller returns to provide the original flow rate of the cooling gas when the pressure in the channel becomes stable.

2. The method of claim 1, wherein the mass flow controller reduces the flow rate of the cooling gas feeding into the channel when the pressure in the channel is increased and returns to provide the original flow rate of the cooling gas when the pressure in the channel becomes stable.

3. The method of claim 2, wherein a range from about 5 sccm to about 50 sccm of the flow rate of the cooling gas is reduced by the mass flow controller.

4. The method of claim 1, wherein the pressure controller reduces the pressure in the channel by accelerating the exhaust rate of the cooling gas.

5. The method of claim 4, wherein a range from about 5 sccm to about 50 sccm of the exhaust rate of the cooling gas is accelerated by the pressure controller.

6. The method of claim 1, further comprising a source of the cooling gas and an evacuation pump, at opposite sides of the lamphead, coupled to the lamphead, wherein the source of the cooling gas and the evacuation pump generate the flow of the cooling gas.

7. The method of claim 6, wherein the vacuum pump extracts the cooling gas at a constant rate whether the pressure controller is working or not.

8. The method of claim 2, wherein a pressure fluctuation in the channel is reduced to substantially zero by the mass flow controller and the pressure controller.

9. The method of claim 1, wherein the pressure sensor is coupled to the channel.

10. The method of claim 9, wherein the pressure controller works each time about 1 torr of the pressure in the channel is sensed to have changed.

11. The method of claim 1, wherein the operation that the pressure controller works to reduce the pressure in the channel when the pressure in the channel is increased, and stops working when the pressure in the channel becomes stable is performed at the operation of feeding the process gas.

12. The method of claim 1, wherein the operation that the pressure controller works to reduce the pressure in the channel when the pressure in the channel is increased, and stops working when the pressure in the channel becomes stable is performed at the operation of ramping up the temperature of the reactor chamber.

13. A method of in situ steam generation oxidation, comprising:

providing a deposition apparatus, which comprises a reactor chamber, a radiant source positioned over the reactor chamber for heating the reactor chamber and a lamphead positioned over the radiant source for cooling the radiant source;

providing a cooling gas flowing through a channel of the lamphead, wherein the cooling gas flows through a mass flow controller before entering into the channel and flows through a pressure controller after leaving the channel, wherein the mass flow controller is provided on a second pipeline that is a bypass pipeline of a first pipeline, wherein the pressure controller is provided on a fourth pipeline that is a bypass pipeline of a third pipeline, wherein the cooling gas does not flow through the first pipeline when the cooling gas is flowing through the mass flow controller, wherein the cooling gas does not flow through the third pipeline when the cooling gas is flowing through the pressure controller;

ramping up the temperature of the reactor chamber to a process temperature to perform the in situ steam generation oxidation to oxidize a substrate in the reactor chamber; and cooling down the temperature of the reactor chamber after an oxide film is formed on the substrate, wherein the mass flow controller reduces the flow rate of the cooling gas feeding into the channel when the pressure in the the channel is increased and returns to provide the original flow rate of the cooling gas when the pressure in the channel becomes stable, wherein a pressure sensor directly senses the pressure in the channel, and the pressure sensor outputs a signal based on the sensed pressure in the channel, wherein the pressure controller and the mass flow controller are electrically connected to the pressure sensor and are configured to receive the signal from the pressure sensor, wherein the mass flow controller is configured to control the flow rate of the cooling gas feeding into the channel based on the signal, wherein the pressure controller control the flow rate of the cooling gas extracting from the channel based on the signal, wherein the mass flow controller reduces the flow rate of the cooling gas feeding into the channel each time the pressure in the channel is not reduced quickly enough by the pressure controller, wherein the mass flow controller returns to provide the original flow rate of the cooling gas when the pressure in the channel becomes stable.

14. The method of claim 13, wherein a range from about 5 sccm to about 50 sccm of the flow rate of the cooling gas is reduced by the mass flow controller.

15. The method of claim 13, further comprising:

sensing the pressure in the channel by the pressure sensor coupled to the channel;

positioning a fiber optical temperature probe through a bottom wall of the deposition apparatus;

detecting the temperature of the reactor chamber by the fiber optical temperature probe; and forming a blackbody cavity by the reflection between the backside of the substrate and the bottom wall.

16. The method of claim 15, wherein the mass flow controller begins to work to reduce the flow rate of the cooling gas feeding into the channel when receiving the signal from the pressure sensor.

17. A method of in situ steam generation oxidation, comprising:

providing a deposition apparatus, which comprises a reactor chamber, a radiant source positioned over the reactor chamber for heating the reactor chamber and a lamphead positioned over the radiant source for cooling the radiant source;

providing a source of the cooling gas and an evacuation pump, at opposite sides of the lamphead, coupled to the lamphead, wherein the source of the cooling gas and the evacuation pump generate the flow of the cooling gas;

providing a mass flow controller between the source of the cooling gas and the lamphead and a pressure controller between the lamphead and the evacuation pump so that the cooling gas flows through the mass flow controller before entering into a channel of the lamphead and flows through the pressure controller after leaving the channel, wherein the mass flow controller is provided on a second pipeline that is a bypass pipeline of a first pipeline, wherein the pressure controller is provided on a fourth pipeline that is a bypass pipeline of a third pipeline, wherein the cooling gas does not flow through the first pipeline when the cooling gas is flowing through the mass flow controller, wherein the cooling gas does not flow through the third pipeline when the cooling gas is flowing through the pressure controller;

providing a pressure sensor directly sensing the pressure in the channel;

transferring a substrate to the reactor chamber;

feeding a process gas into the reactor chamber; and ramping up the temperature of the reactor chamber to a process temperature to perform the in situ steam generation oxidation to oxidize the substrate;

wherein the pressure sensor outputs a signal based on the sensed pressure in the channel, wherein the pressure controller is electrically connected to the pressure sensor and is able to receive the signal;

wherein the mass flow controller reduces the flow rate of the cooling gas feeding into the channel and the pressure controller works to accelerate the exhaust rate of the cooling gas from the channel when the signal indicates that the pressure in the channel is increased, and the mass flow controller returns to provide the original flow rate of the cooling gas and the pressure controller stops working when the signal indicates that the pressure in the channel becomes stable, wherein the mass flow controller is electrically connected to the pressure sensor and is configured to receive the signal from the pressure sensor, wherein the mass flow controller is configured to control the flow rate of the cooling gas feeding into the channel based on the signal, wherein the mass flow controller reduces the flow rate of the cooling gas feeding into the channel each time the pressure in the channel is not reduced quickly enough by the pressure controller, wherein the mass flow controller returns to provide the original flow rate of the cooling gas when the pressure in the channel becomes stable.

18. The method of claim 17, wherein the pressure sensor is coupled to the channel, wherein the radiant source comprises a tungsten halogen lamp.

19. The method of claim 18, wherein the mass flow controller begins to work to reduce the flow rate of the cooling gas feeding into the channel and the pressure controller begins to work to accelerate the exhaust rate of the cooling gas from the channel when receiving the mass flow controller and the pressure controller respectively receive the signal from the pressure sensor.

20. The method of claim 17, wherein a pressure fluctuation in the channel is reduced to substantially zero by the mass flow controller and the pressure controller.

* * * * *